US007310920B2

(12) United States Patent
Hovey, Jr.

(10) Patent No.: US 7,310,920 B2
(45) Date of Patent: Dec. 25, 2007

(54) TWO-WAY ARCHITECTURAL STRUCTURAL SYSTEM AND MODULAR SUPPORT MEMBER

(76) Inventor: David Hovey, Jr., 10052 E. Relic Rock Rd., Scottsdale, AZ (US) 85262

( * ) Notice: Subject to any disclaimer, the term of this patent is extended or adjusted under 35 U.S.C. 154(b) by 0 days.

(21) Appl. No.: 10/840,440

(22) Filed: May 6, 2004

(65) Prior Publication Data

US 2005/0252161 A1 Nov. 17, 2005

(51) Int. Cl.
*E02D 27/00* (2006.01)

(52) U.S. Cl. ..... 52/655.1; 52/729.1; 52/282.1; 52/653.1; 52/656.1

(58) Field of Classification Search ..... 52/729.1, 52/712, 651.08, 656.1, 650.1, 263, 654.1, 52/653.1, 292, 282.2, 655.1; 403/169, 170, 403/174, 178
See application file for complete search history.

(56) References Cited

U.S. PATENT DOCUMENTS

| | | | | |
|---|---|---|---|---|
| 1,009,996 | A | 11/1911 | Rifflard | |
| 1,818,418 | A | 8/1931 | Millard | |
| 1,958,473 | A | 5/1934 | Dovell | |
| 1,996,641 | A | 4/1935 | Coleman | |
| 2,658,776 | A | 11/1953 | Wilcox | |
| 2,675,895 | A * | 4/1954 | Loewenstein | 52/236.3 |
| 2,943,716 | A | 7/1960 | Babcock | |
| 3,372,518 | A * | 3/1968 | Rensch | 52/223.7 |
| 3,688,461 | A * | 9/1972 | Rensch et al. | 52/653.1 |
| 3,706,169 | A * | 12/1972 | Rensch | 52/263 |
| 3,827,377 | A * | 8/1974 | Aughtry, Jr. | 108/108 |
| 3,914,063 | A | 10/1975 | Papayoti | |
| 4,122,646 | A * | 10/1978 | Sapp | 52/651.05 |
| 4,688,358 | A * | 8/1987 | Madray | 52/93.2 |
| 5,090,166 | A | 2/1992 | Johnson et al. | |
| 5,289,665 | A | 3/1994 | Higgins | |
| 5,577,353 | A | 11/1996 | Simpson | |
| 5,660,017 | A | 8/1997 | Houghton | |
| 5,664,392 | A | 9/1997 | Mucha | |
| 5,680,738 | A | 10/1997 | Allen et al. | |
| 5,806,265 | A | 9/1998 | Sluiter | |
| 5,901,523 | A | 5/1999 | Tasi | |
| 6,032,431 | A | 3/2000 | Sugiyama | |
| 6,047,513 | A | 4/2000 | Gibson | |
| 6,059,482 | A | 5/2000 | Beauvoir | |

(Continued)

FOREIGN PATENT DOCUMENTS

EP 0 864 702 A1 9/1998

(Continued)

OTHER PUBLICATIONS

International Search Report for PCT/US2005/004462 mailed Jun. 1, 2005.

*Primary Examiner*—Basil Katcheves
(74) *Attorney, Agent, or Firm*—Schwartz Cooper Chartered

(57) ABSTRACT

An architectural structural system comprises a structural beam and a structural connector. The structural beam includes a first c-beam and a second c-beam adjacently disposed one in parallel to the other. Each of the c-beams has opposed first and second ends. The structural connector has a plurality of transverse blades with opposed faces, one of the plurality of blades being connectedly disposed between the first and second c-beams.

34 Claims, 20 Drawing Sheets

U.S. PATENT DOCUMENTS

| | | | |
|---|---|---|---|
| 6,073,405 | A | 6/2000 | Kasai et al. |
| 6,076,325 | A | 6/2000 | Sluiter |
| 6,092,347 | A | 7/2000 | Hou |
| 6,138,427 | A | 10/2000 | Houghton |
| 6,212,850 | B1 | 4/2001 | Branson |
| 6,223,494 | B1 | 5/2001 | Bright |
| 6,230,467 | B1 | 5/2001 | Leek |
| 6,237,303 | B1 | 5/2001 | Allen et al. |
| 6,272,796 | B1 | 8/2001 | Metzler |
| 6,276,094 | B1 | 8/2001 | Hays |
| 6,298,630 | B1 | 10/2001 | VeRost et al. |
| 6,430,890 | B1 | 8/2002 | Chiwhane et al. |
| 6,474,902 | B1 | 11/2002 | Beauvoir |
| 6,493,998 | B1 | 12/2002 | Pryor |
| 6,516,583 | B1 | 2/2003 | Houghton |
| 6,802,169 | B2 * | 10/2004 | Simmons ..... 52/648.1 |

FOREIGN PATENT DOCUMENTS

| | | |
|---|---|---|
| FR | 2734297 | 11/1996 |
| SE | 468 255 B | 11/1992 |
| WO | WO 03/080951 A1 | 10/2003 |
| WO | WO 03/091514 A1 | 11/2003 |

* cited by examiner

TWO-WAY ARCHITECTURAL STRUCTURAL SYSTEM AND MODULAR SUPPORT MEMBER

TECHNICAL FIELD

This invention relates generally to a modular architectural structural system and prefabricated modular building system. More particularly, the present invention relates to a repeatable structural system that offers two-way directional strength and support for an architectural structure.

BACKGROUND OF THE INVENTION

Steel frame architectural structures such as buildings and the like have been constructed using either welded connections or bolted fittings between beams and columns to achieve an assembly capable of bracing structures against lateral loads. In such structures, steel beams and columns are arranged and fastened together using known engineering principles and practices to form the skeletal backbone of the structure.

The arrangement of the beams and columns is critical ensuring that the framework of beams and columns can support the stresses, strains and loads contemplated for the intended use of the structure. It is equally important to determine the manner in which such stresses, strains and loads are transferred from beam to beam, beam to column and column to foundation throughout the structure. Accordingly, much attention must also be given to the means by which beams and columns are connected in an architectural structure.

Many traditional connectors used in structural systems are "one-way" connectors, meaning that the connectors result in the structural components bearing or transferring loads only in a single direction. While such structures have enjoyed a great deal of success, the one-way systems do not facilitate maximum strength and support of the structure.

The present invention is provided to solve these and other problems, and to provide advantages and aspects not provided by prior architectural structural systems of this type.

SUMMARY OF THE INVENTION

The present invention provides an architectural structural system and an overall prefabricated modular building system. The architectural structural system comprises a structural beam and a structural connector. The structural beam comprises a first c-beam and second c-beam adjacently disposed one in parallel to the other.

According to another aspect of the present invention, the first and second c-beams are adjacently disposed one in parallel to the other, and are securably connected one to the other to create an I-beam. A slot is provided between the first and second c-beams to receive a connector therein.

According to yet another aspect of the present invention, a structural connector for an architectural structural system is provided. The structural connector comprises a blade having opposed first and second ends and opposed faces. Alternatively, the connector comprises a plurality of transverse blades having opposed faces. One of the blades is connectedly disposed between the first and second c-beams. According to both aspects, the blades are provided to be connectedly disposed between the first and second c-beams.

According to still another aspect of the present invention, another embodiment of a structural connector for an architectural structural system is provided. According to this aspect, the structural connector further includes a column adaptor. The column adaptor comprises a plurality of blades extending perpendicularly to the transverse blades proximate the juncture of the transverse blades.

According to another aspect of the present invention, a repeatable framework for an architectural structural system is provided. The repeatable framework comprises a plurality of connectors, a plurality of structural beams and a plurality of structural columns. According to this aspect of the invention each of the connectors comprises a beam adaptor and at least one column adaptor. The beam adaptor comprises a plurality of transverse blades having opposed faces. The column adaptors comprise a plurality of blades extending perpendicularly from the beam adaptor proximate the juncture of the transverse blades. Each of the structural beams comprises a pair of adjacently disposed c-beams connected at opposed ends by one the connectors. Each structural beam is in turn connected to another of the structural beams by another of the plurality of blades of a common structural connector. The columns each comprise a plurality of adjacently disposed elongated angled plates. Each column is connected at opposed ends to two of the plurality of structural beams by common connectors.

According to another aspect of the present invention, the repeatable framework can be assembled in a variety of ways to achieve the completed architectural structure. Structural members many be separately brought to a site and assembled. Alternatively, structural members may be remotely assembled in modules and subsequently transported to a desired site for construction of the architectural structure.

According to another aspect of the present invention, the repeatable framework includes a plurality of apertures in the c-beams. The apertures provide raceways for HVAC, electrical and plumbing.

According to another aspect of the present invention, floor and roof plates are attached to the top of the beams to provide a structural walking surface as well as concealing and, or sealing the area within the beams. Sub-floor or sub-roof plates may be attached to the beams to provide concealing and, or sealing the area within the beam.

According to yet another aspect of the present invention, the repeatable modules may be sealed to create an area for forced air to be used as a plenum box. Roof fascia may be provided to edge and conceal roofing material as well as any utilities/HVAC located on roof.

These and other objects, advantages and aspects will be made apparent from the following description of the drawings and detailed description of the invention.

DETAILED DESCRIPTION OF THE FIGURES

Figure 8A:
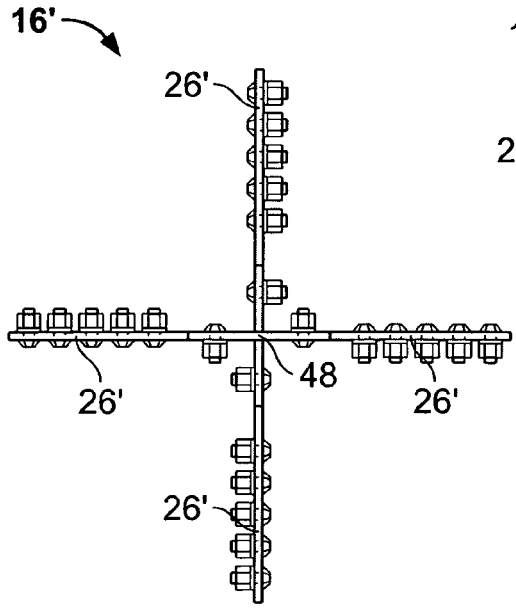
Figure 8B:
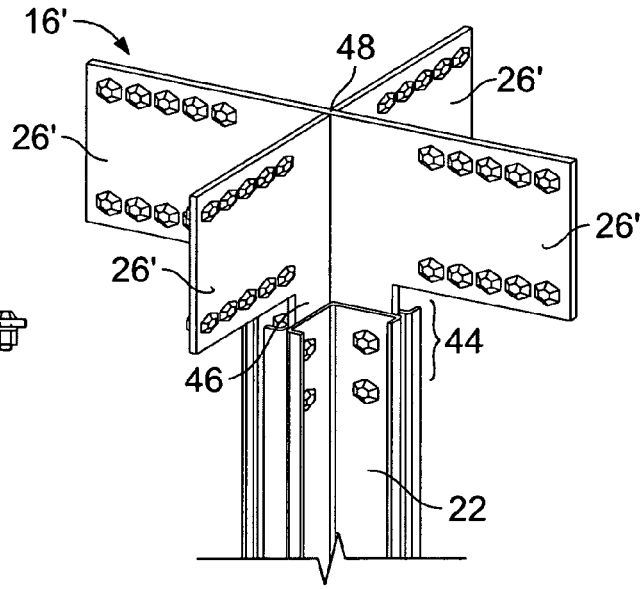
Figure 9A:
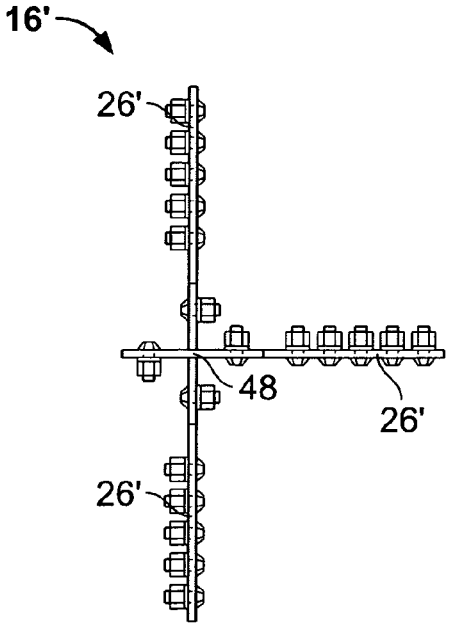
Figure 9B:
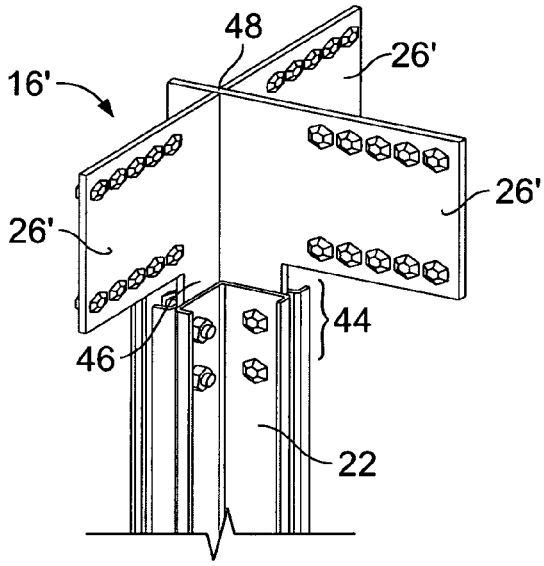
Figure 10A:
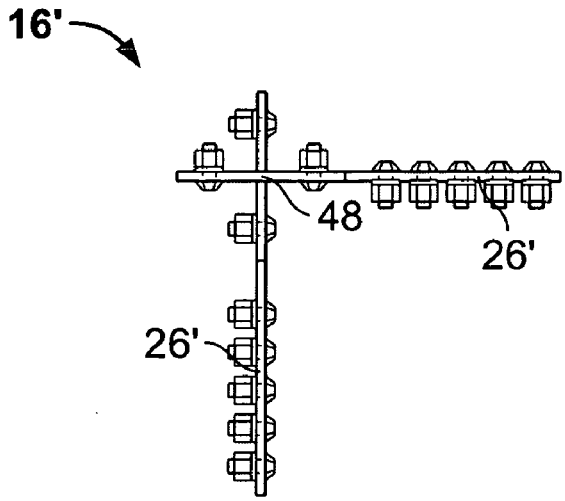
Figure 10B:
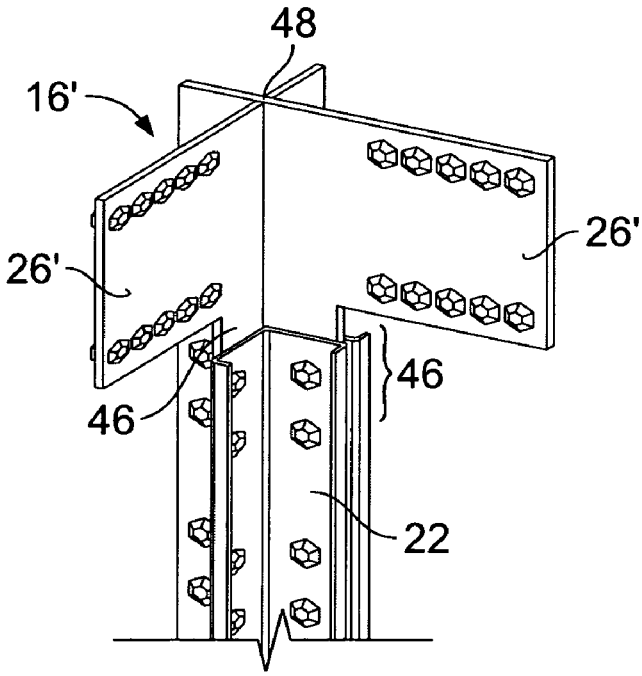
Figure 11:
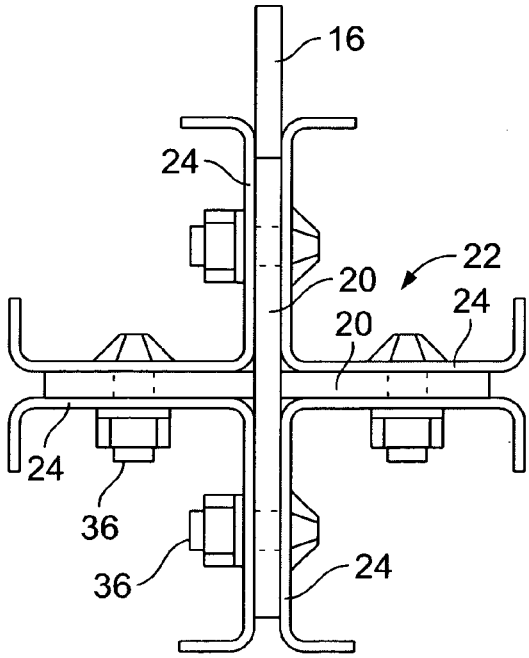
Figure 12:
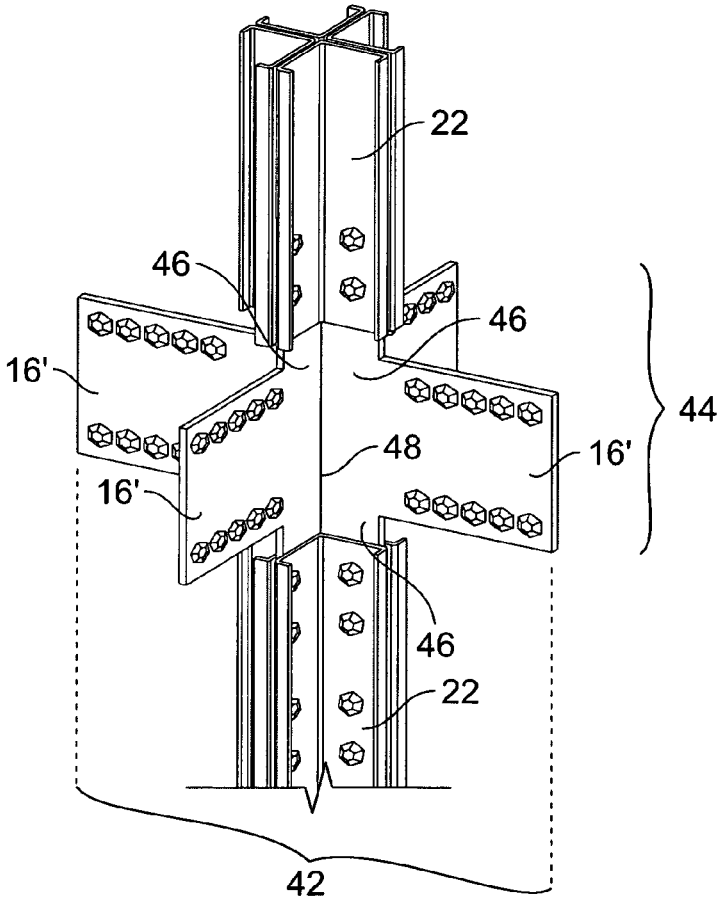
Figure 13:
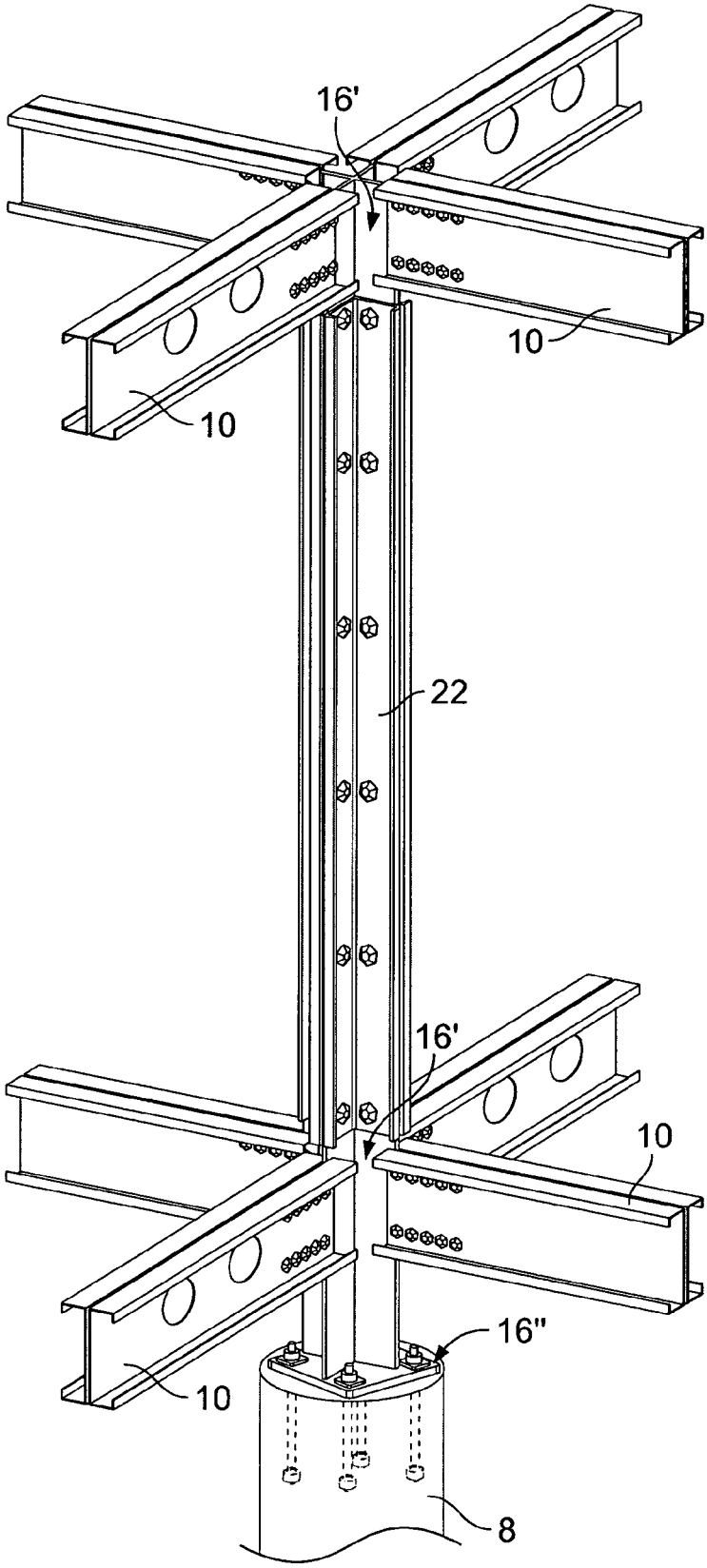
Figure 14:
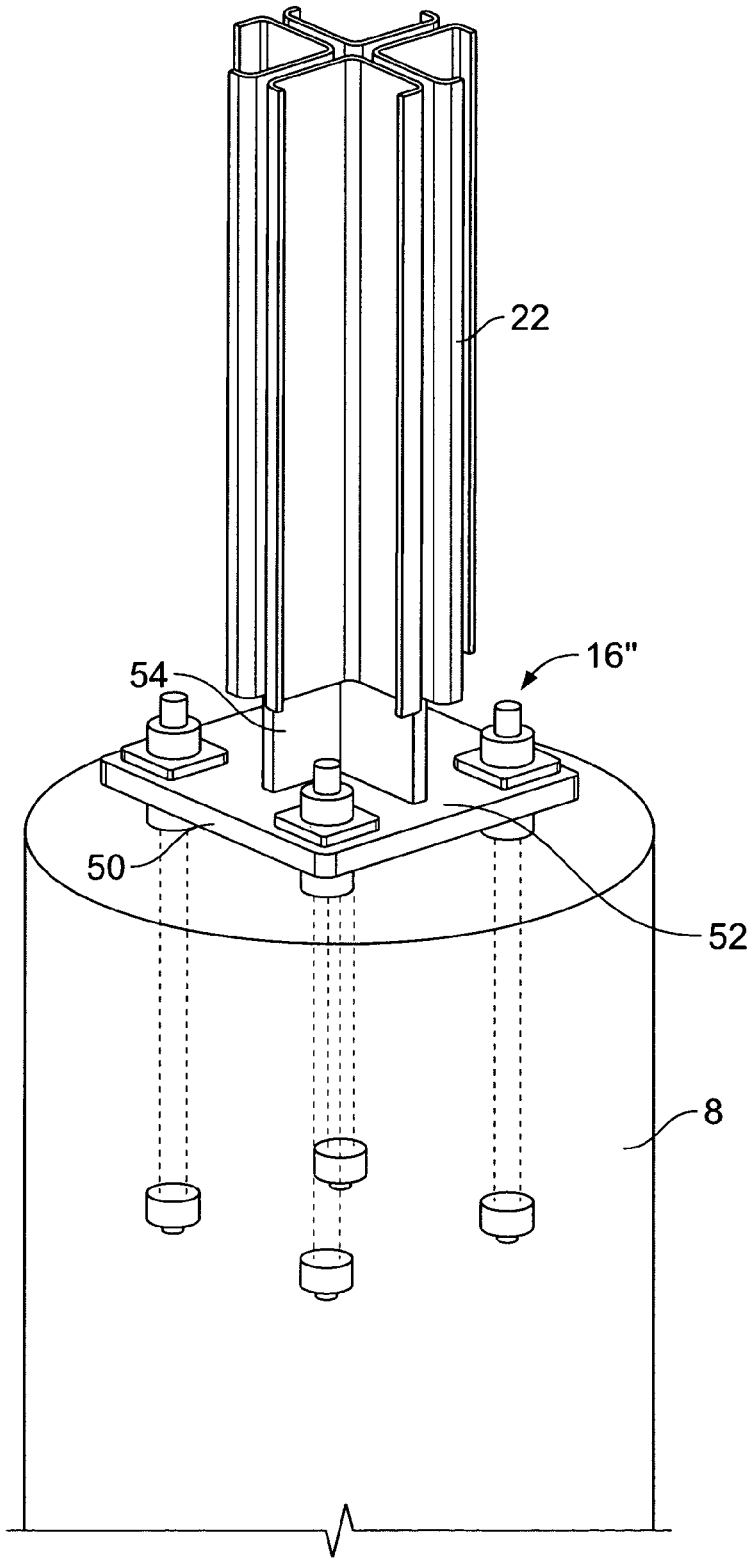
Figure 15:
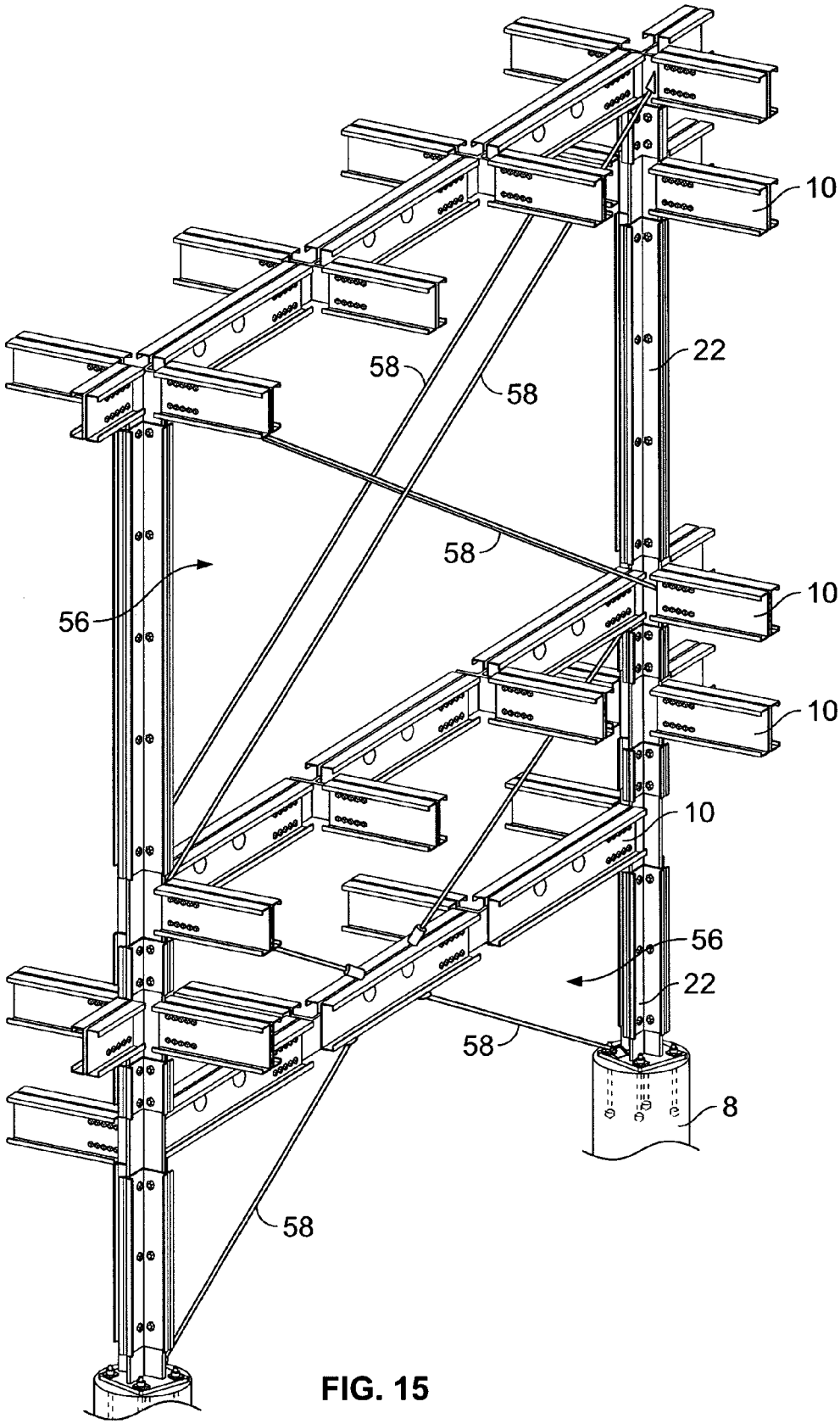
Figure 16:
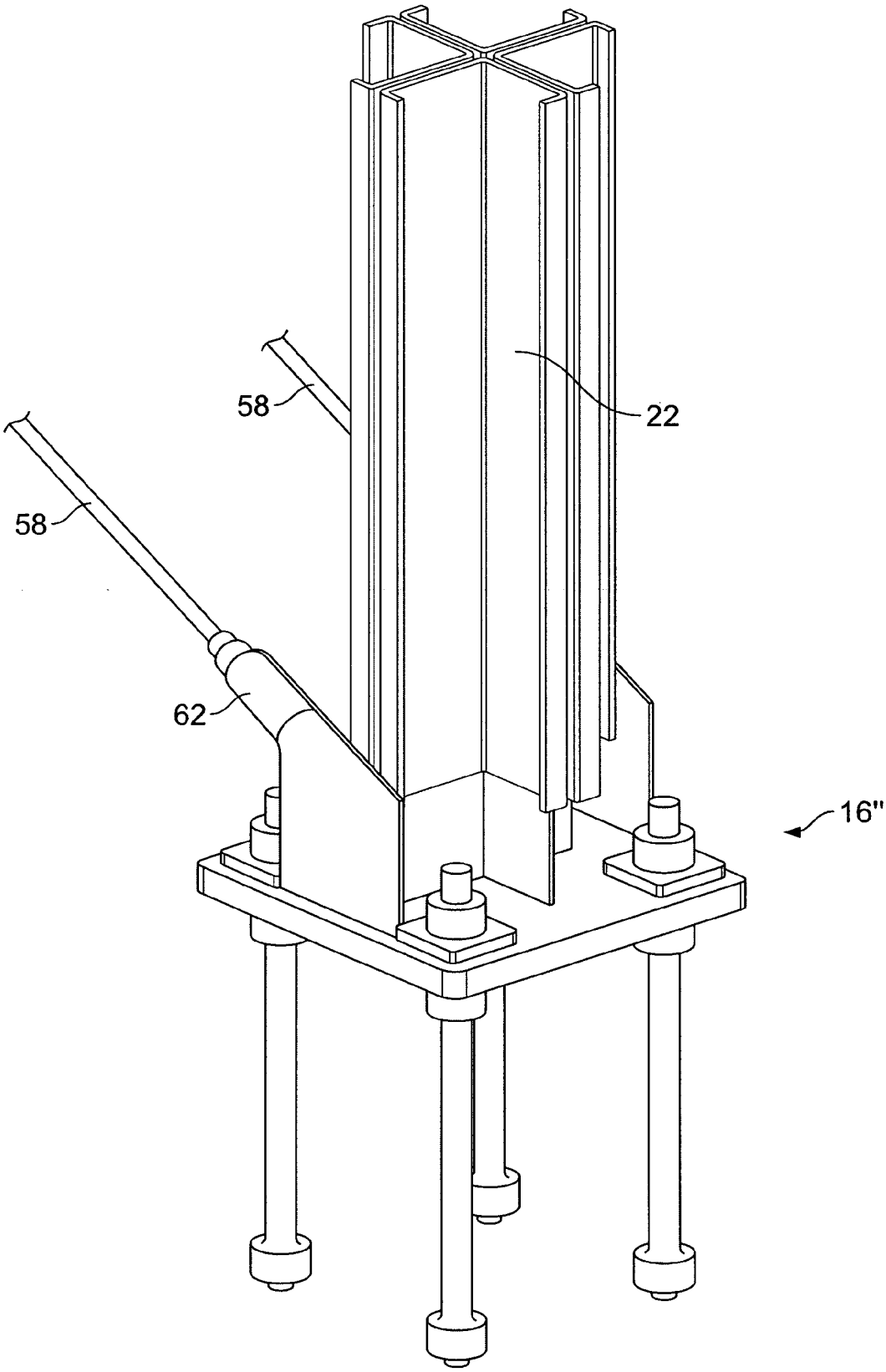
Figure 17:
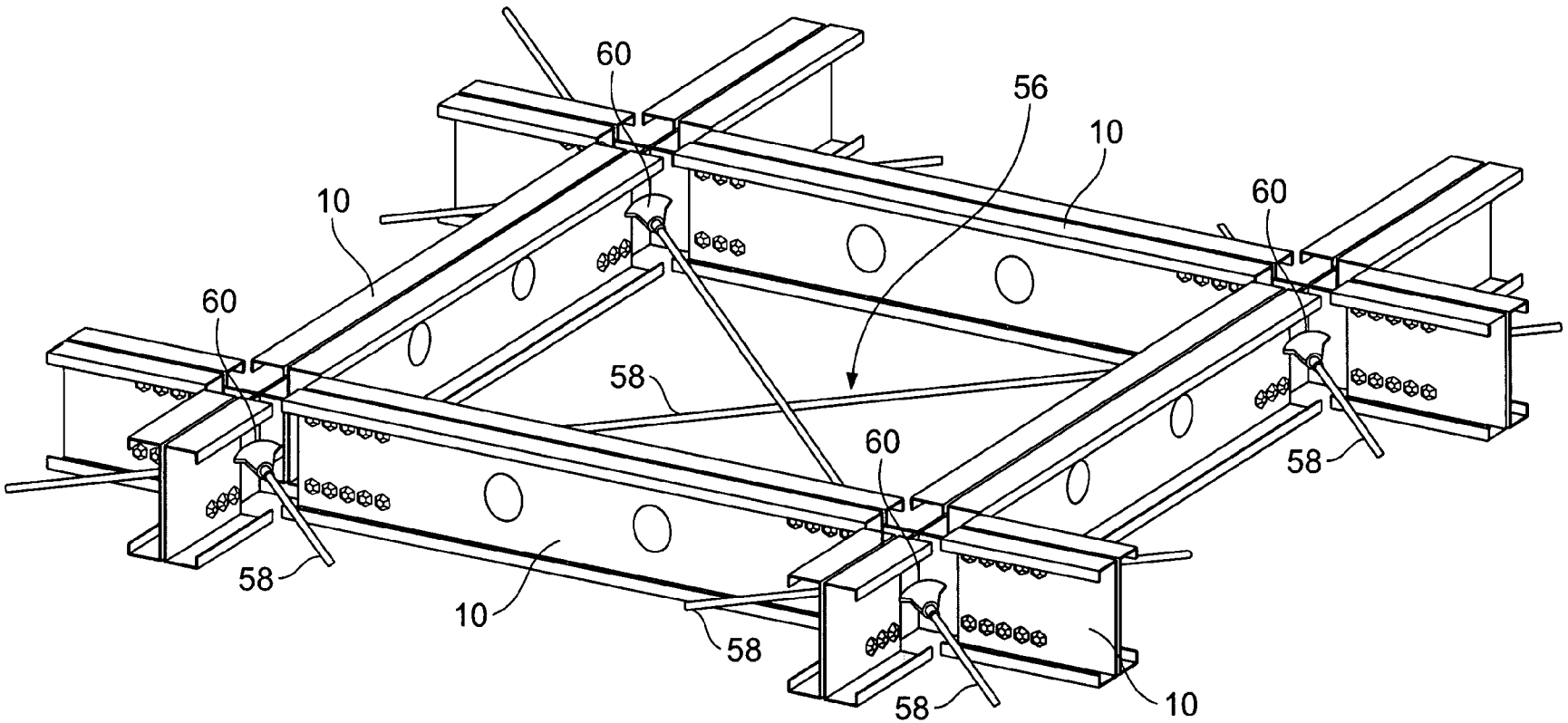
Figure 18:
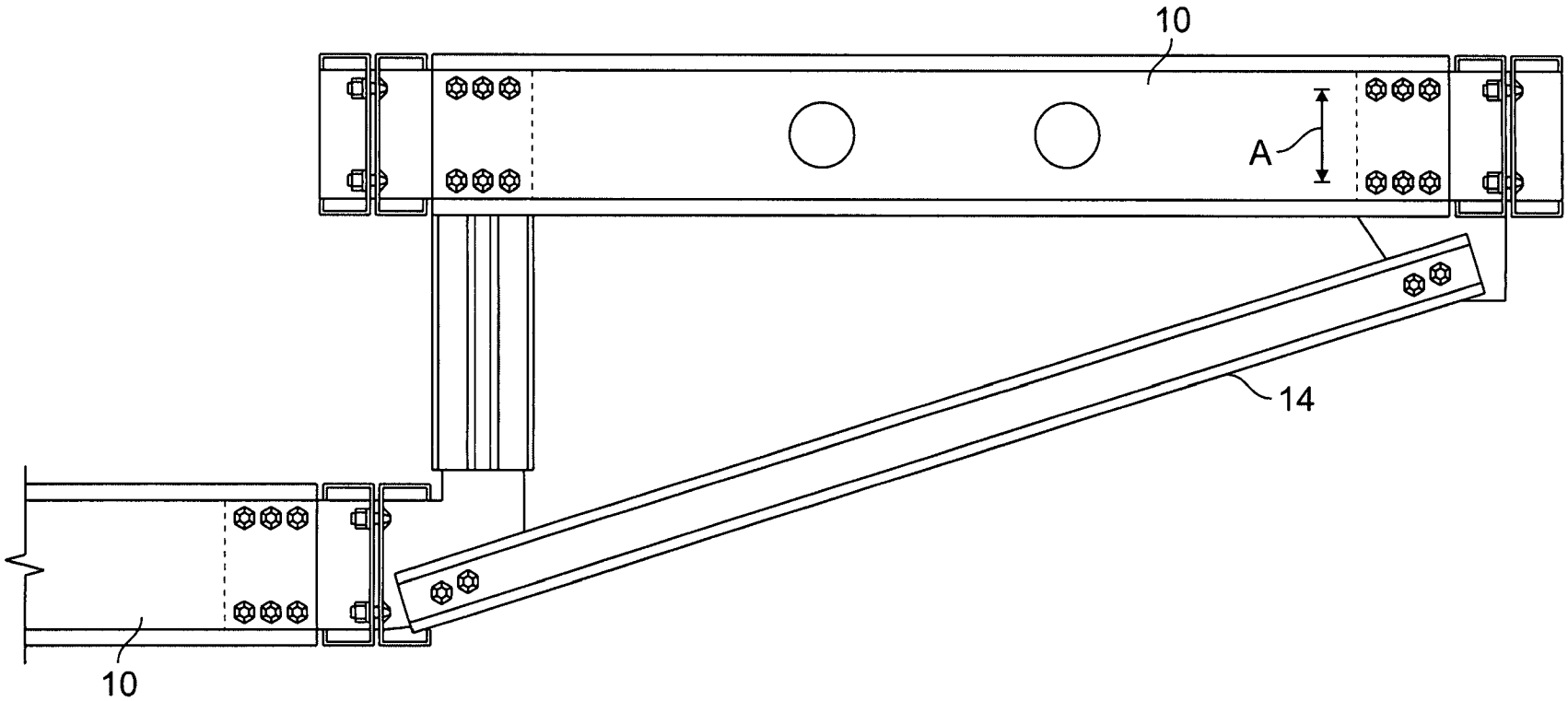
Figure 19:
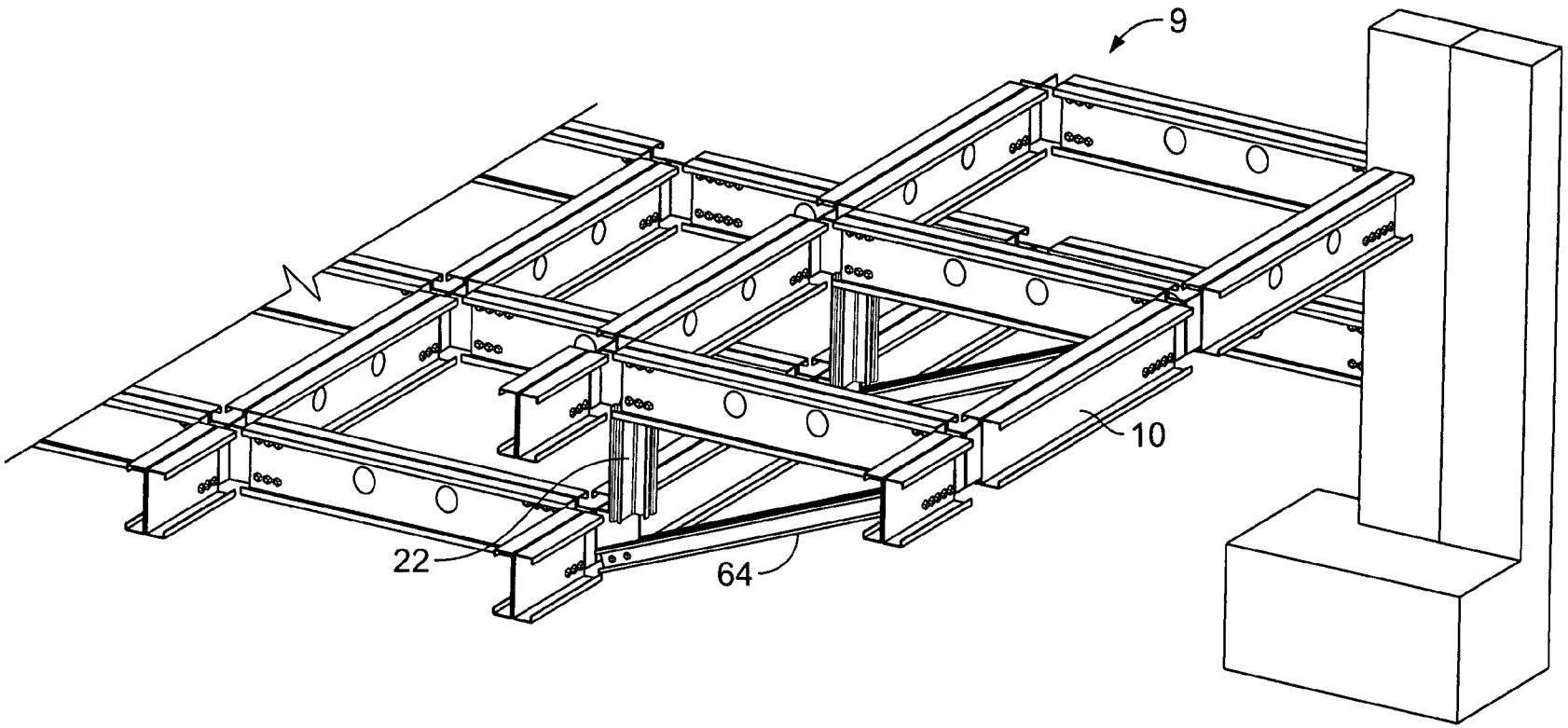
Figure 20:
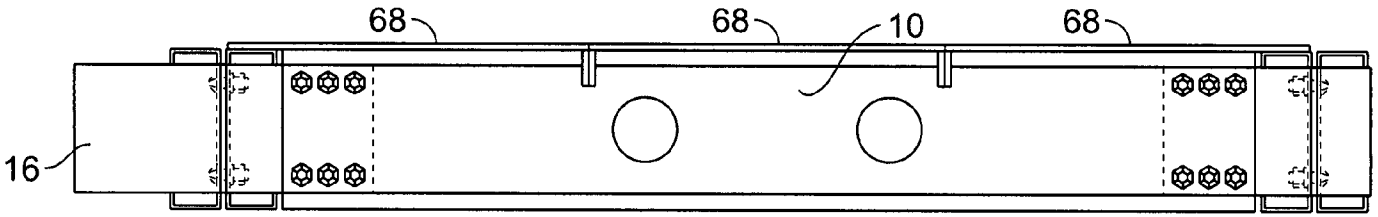
Figure 21:
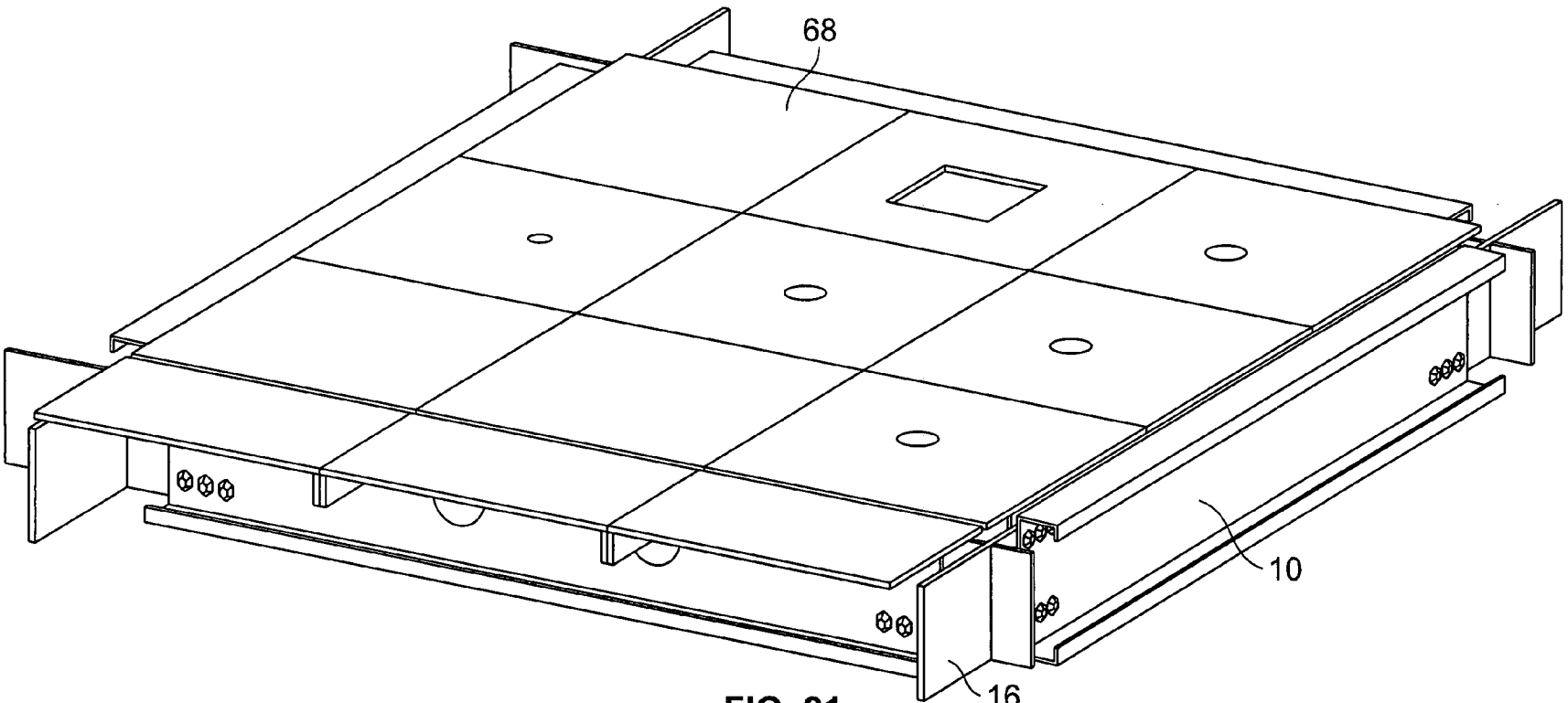
Figure 22:
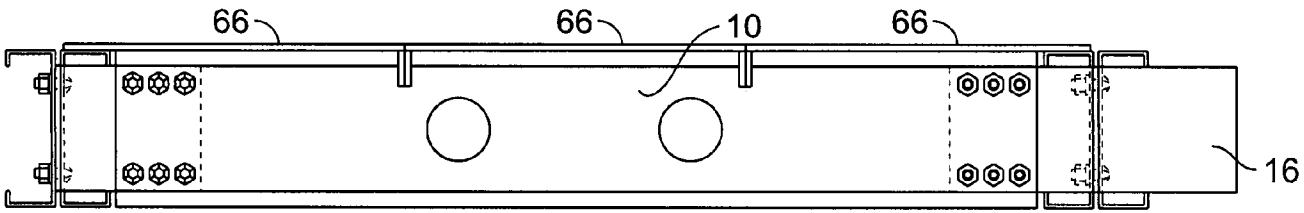
Figure 23:
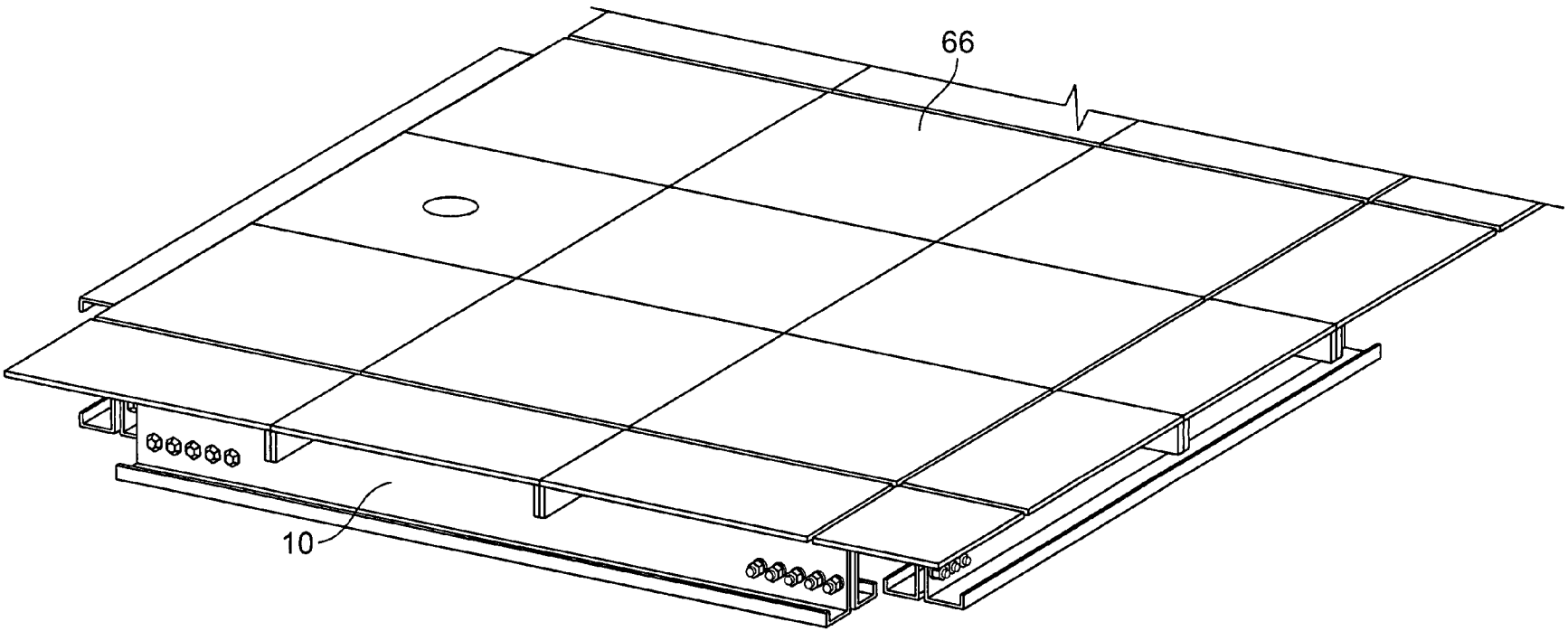
Figure 24:
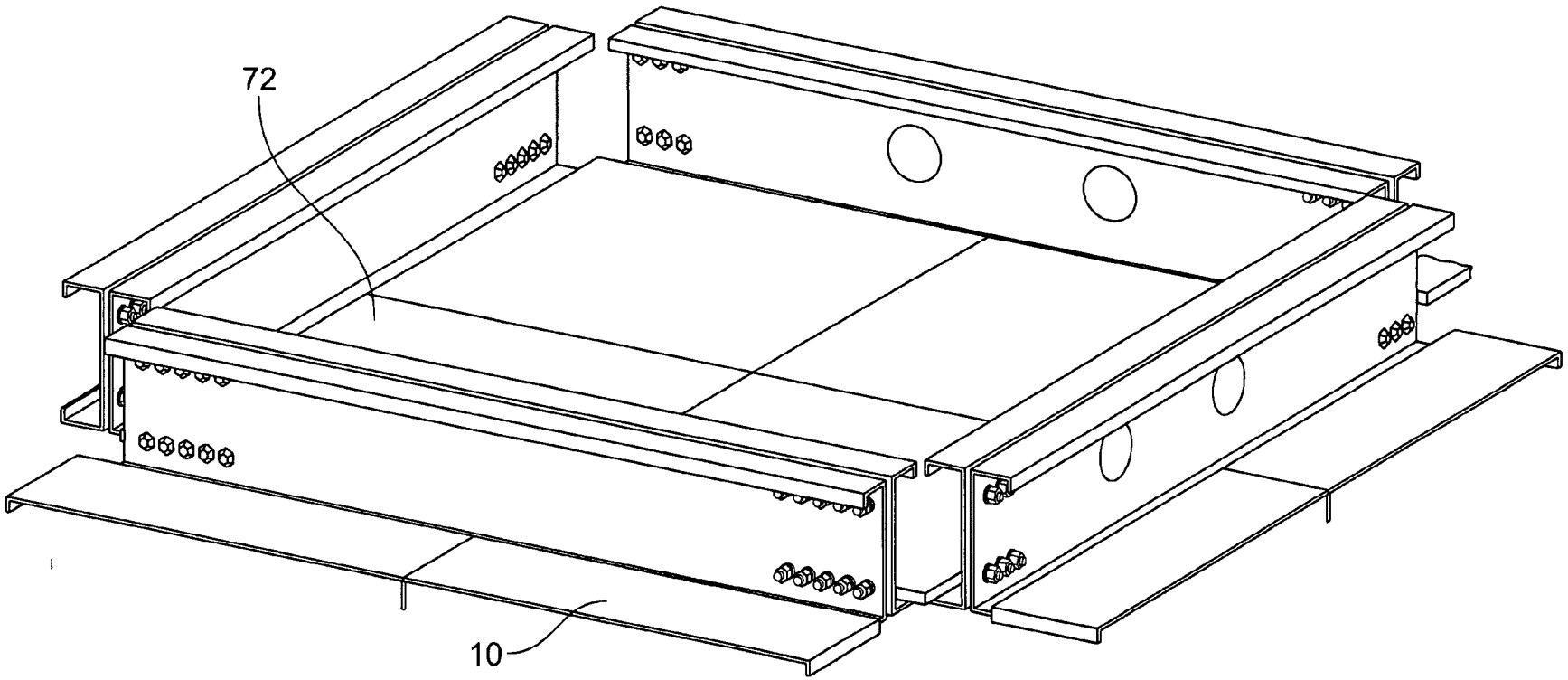
Figure 25:
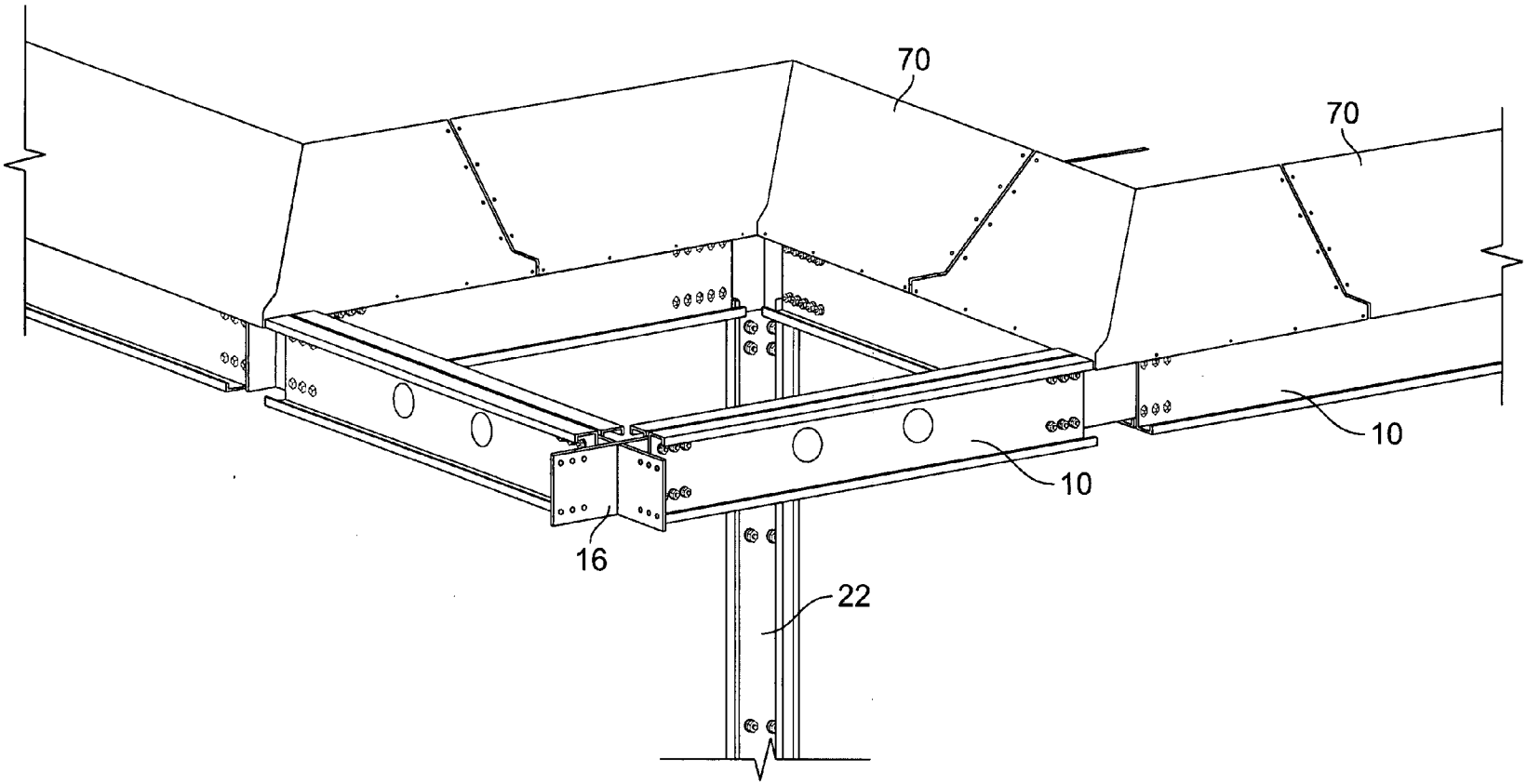
Figure 26:
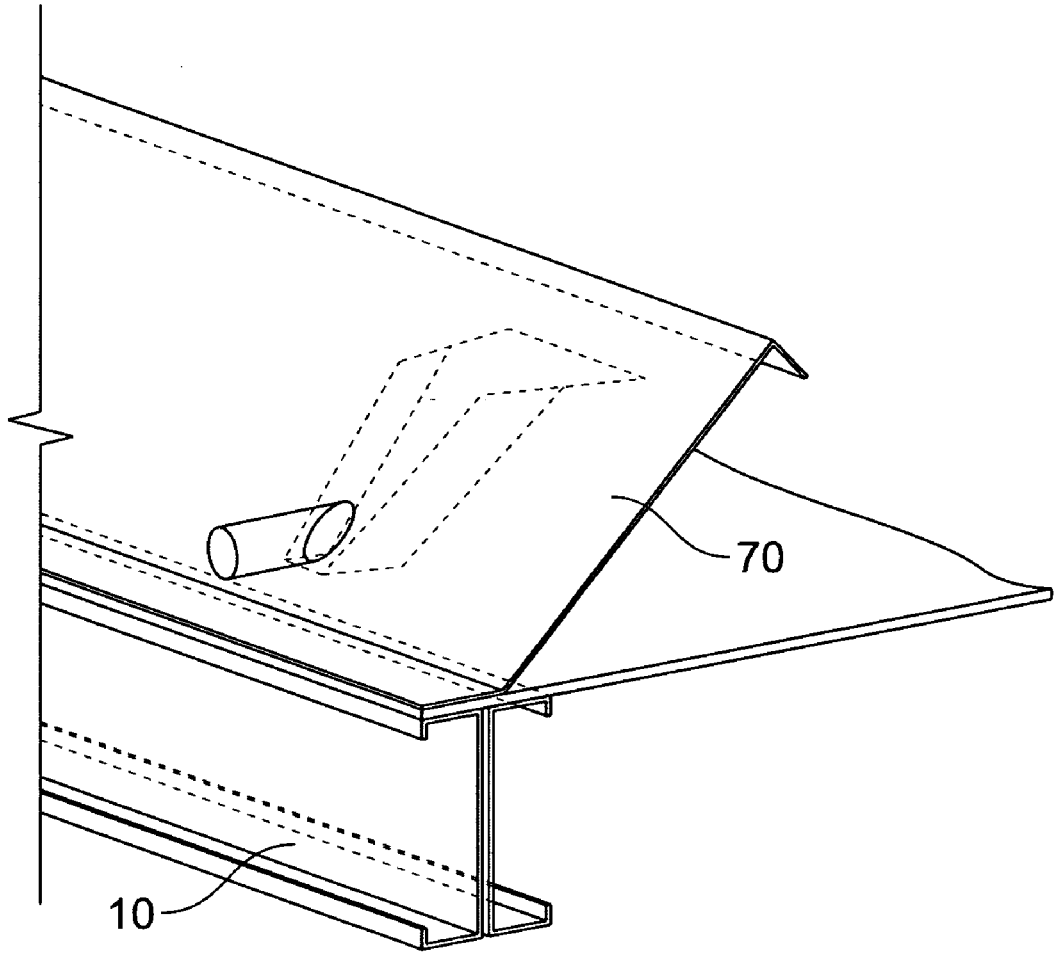
Figure 27:
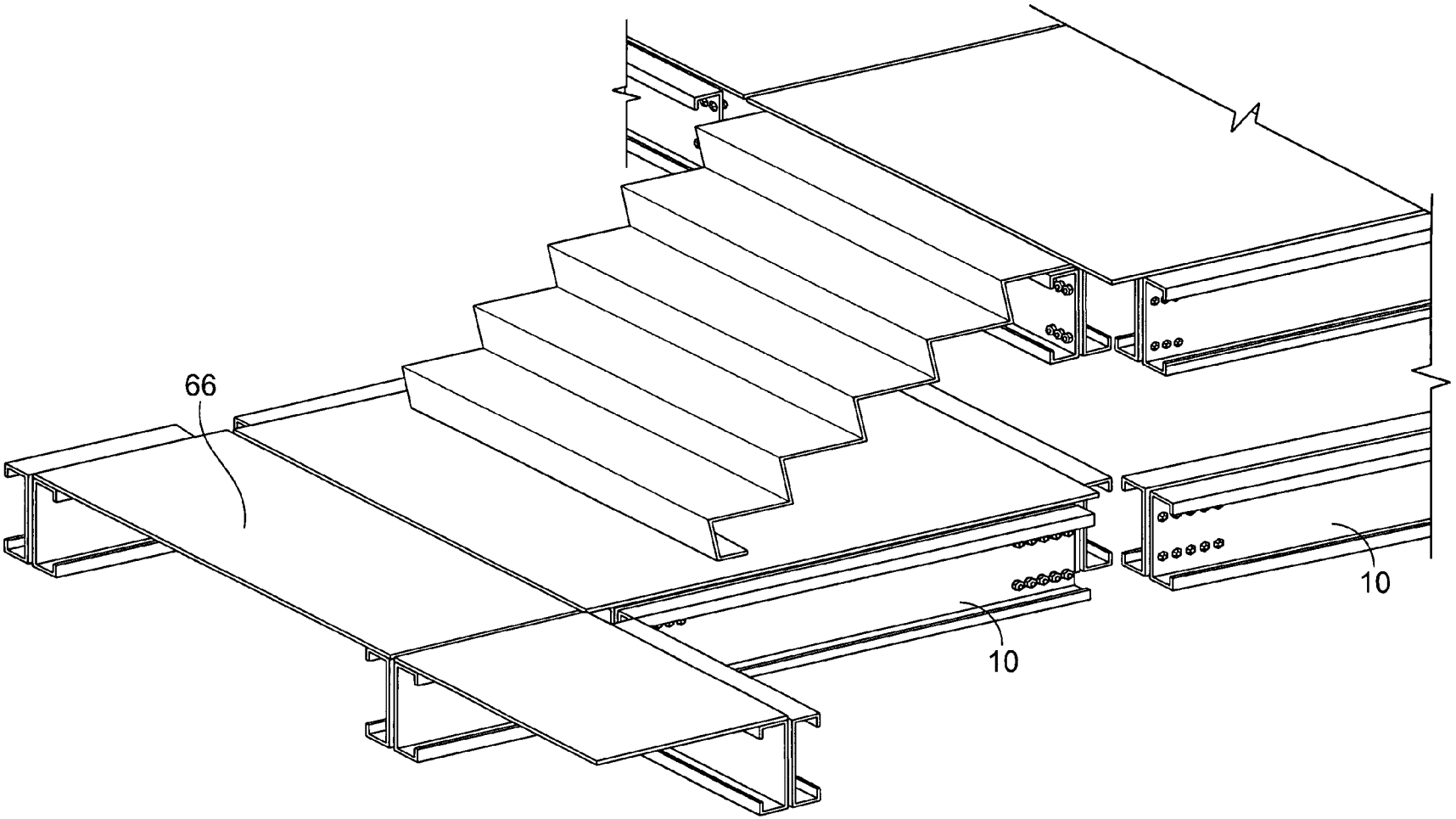

FIG. 8*a* is a top view of one embodiment of a roof beam to column connector according to the present invention;

FIG. 8*b* is a perspective view of one embodiment of a roof beam to column connector according to the present invention;

FIG. 9*a* is a top view of another embodiment of a roof beam to column connector according to the present invention;

FIG. 9*b* is a perspective view of another embodiment of a roof beam to column connector according to the present invention;

FIG. 10*a* is a top view of another embodiment of a roof beam to column connector according to the present invention;

FIG. 10*b* is a perspective view of another embodiment of a roof beam to column connector according to the present invention;

FIG. 11 is an end plan view of a structural column according to the present invention;

FIG. 12 is a perspective view of one embodiment of a floor beam to upper and lower columnar connector according to the present invention;

FIG. 13 is a perspective view of one embodiment of a beam and column assembly according to the present invention;

FIG. 14 is a perspective view of a foundational connector according to the present invention;

FIG. 15 is a perspective view of an architectural structure according to the present invention showing vertical cross bracing;

FIG. 16 is a perspective view of a foundational connector according to the present invention with cross bracing attachment;

FIG. 17 is a perspective view of an architectural structure according to the present invention showing horizontal cross bracing;

FIG. 18 is a side elevation view of an elbow according to the present invention;

FIG. 19 is a perspective view of an elbow according to the present invention;

FIG. 20 is a side elevation view of the roof plate according to the present invention;

FIG. 21 is a perspective view of the roof plate according to the present invention;

FIG. 22 is a side elevation view of the floor plate according to the present invention;

FIG. 23 is a perspective view of the floor plate according to the present invention;

FIG. 24 is a perspective view of the sub-floor plate according to the present invention;

FIG. 25 is a partial perspective view of the roof with fascia according to the present invention;

FIG. 26 is a partial perspective view of the fascia according to the present invention; and, FIG. 27 is a perspective view of an exemplary illustration of two adjacent floors of the architectural structure of the present invention.

DETAILED DESCRIPTION OF THE PREFERRED EMBODIMENT

While the present invention is susceptible of embodiment in many different forms, there is shown in the drawings and will herein be described in detail preferred embodiments of the invention. It is to be understood that the present disclosure is to be considered as an exemplification of the principles of the invention. This disclosure is not intended to limit the broad aspects of the invention to the illustrated embodiments.

The present architectural structural system results in an efficient two-way, continuous structural action of the floor and the roof framing, and consequent two-way system for prefabricated roof and floor decks. These benefits arise as a result of utilizing structural modules that are inherently adaptable to cantilevers in at least two directions with no additional material, and which are adaptable to changes in surface elevations (e.g., to conform to site topography. The present invention is generally directed to an architectural structural system defined by a repeatable modular framework. Because a repeatable system is employed, a modular structural bay 9 can be brought to a predetermined site, and the structure can be fully assembled using prefabricated modules. Alternatively, the building may be fully assembled off-site with the same prefabricated modules and subsequently transported to a desired location.

Figure 1:
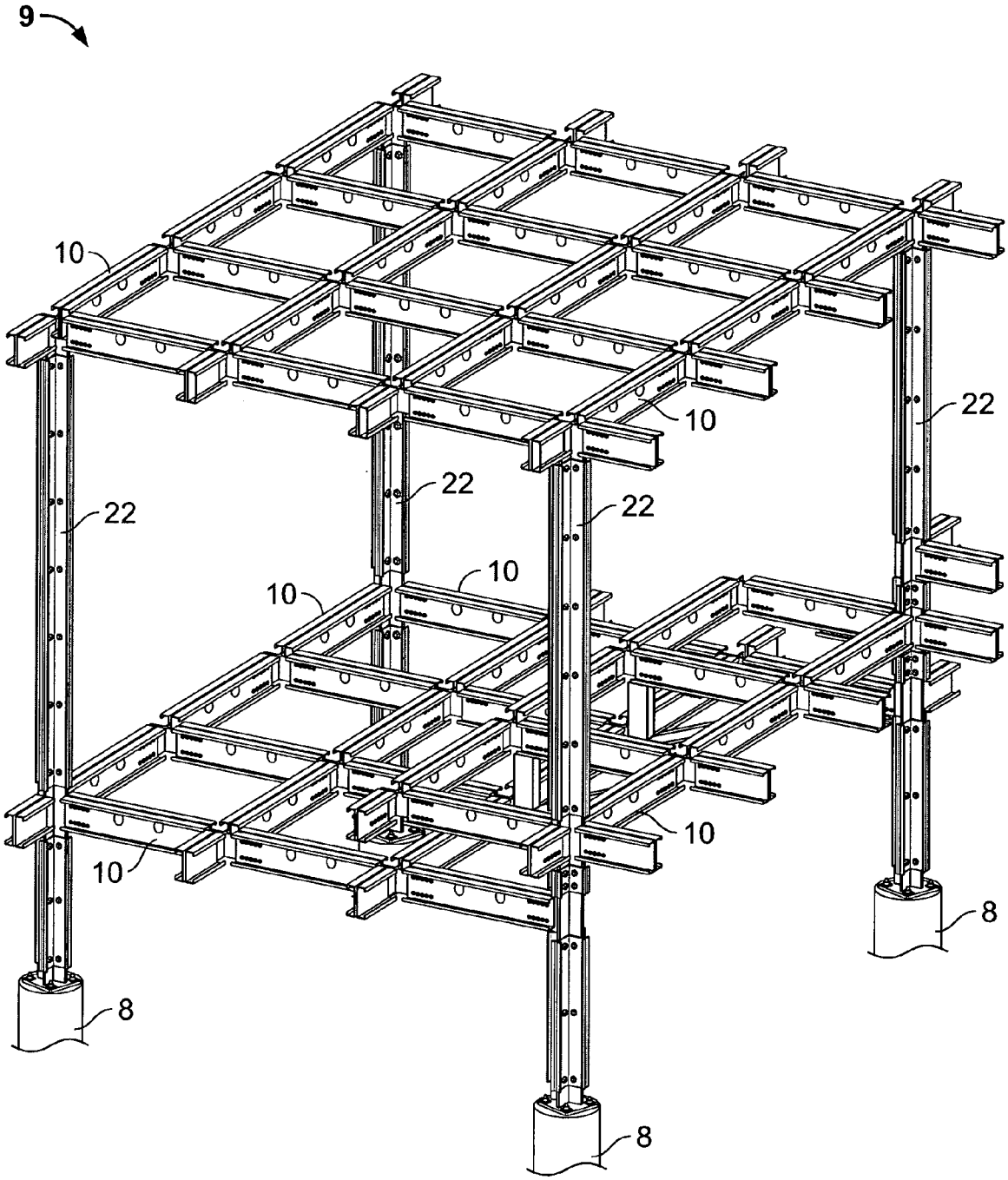
FIG. 1 is a perspective view of a repeatable structural bay constructed according to the present invention.

As shown in FIG. 1, the repeatable framework of the present invention is a structural bay 9 comprised of a plurality of structural beams 10, columns 22 and connectors 16, 16', 16". Although the structural bay according to the present invention is preferably a 21'×21' module, a bay of any size may be employed without departing from the present invention. The structural bay 9 becomes repeatable by securably connecting a plurality of like structural bays 9 using a series connectors 16, 16', 16" that uniformly transfer loads throughout the structure from structural beams 10 to adjacent beams 10, columns 22 and eventually to the foundation 8. The components architectural structural system of the present invention will now will be described in detail.

Figure 2:
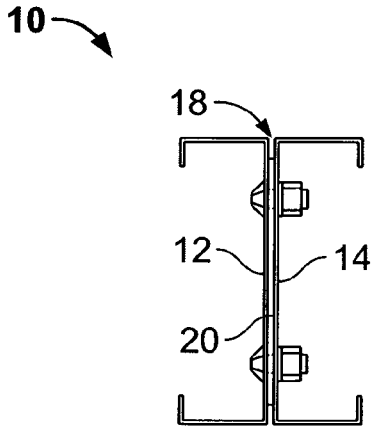
FIG. 2 is an end view of a beam according to the present invention.
Figure 3:
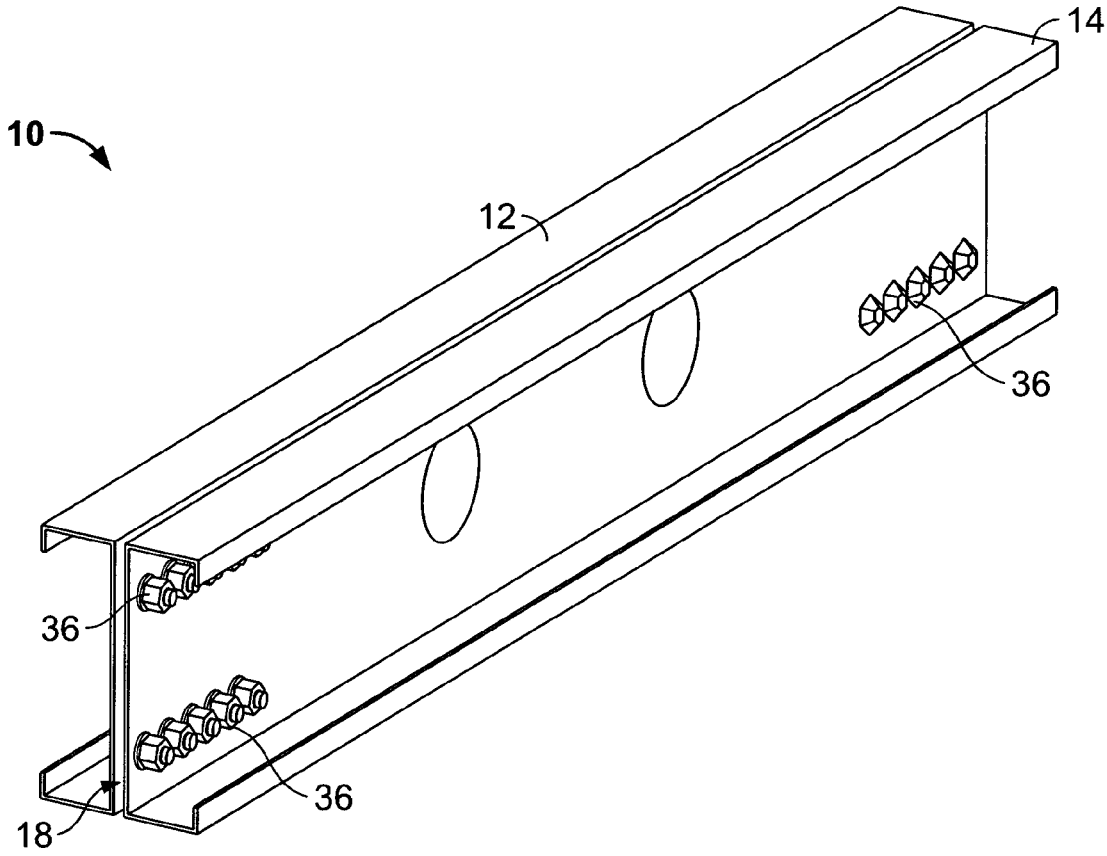
FIG. 3 is a perspective view of a beam according to the present invention.
Figure 7:
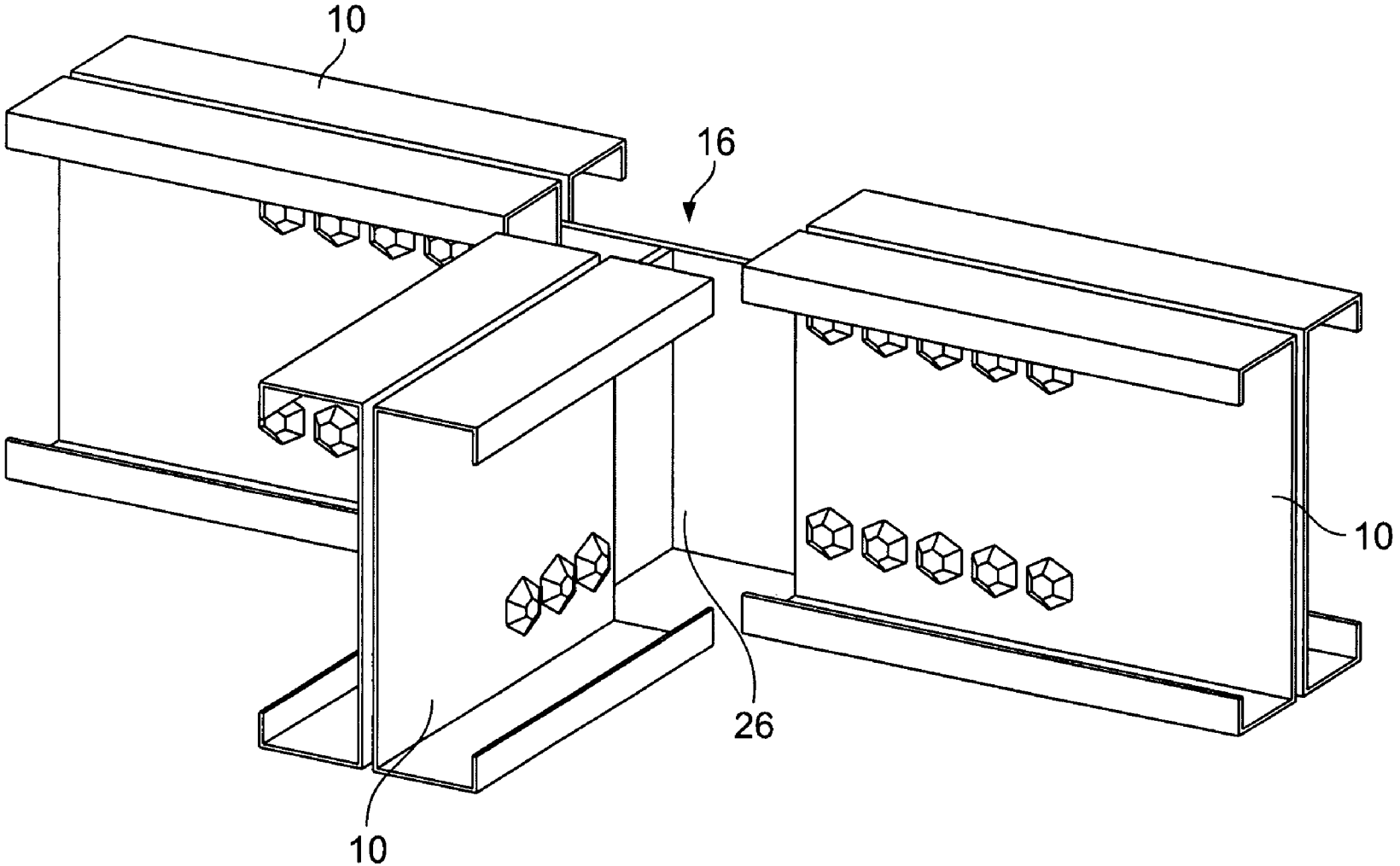
FIG. 7 is a perspective view of a connector and beam assembly according to the present invention.

As may be seen in FIGS. 2 and 3, the structural beam 10 used in connection with the present invention is comprised of a first c-beam 12 and second c-beam 14, each c-beam 12, 14 having opposed first and second ends. As shown in FIG. 7, the first and second c-beams 12, 14 are adjacently disposed one parallel to the other, and securably connected one to the other by sandwiching the c-beams 12, 14 around a structural connector 16, 16', 16". The c-beams 12, 14 are preferably 12" deep, ⅛" thick steel plate press formed into "C" shapes, and when assembled according to the present invention, are fastened back to back to create an I-beam configuration. According to the present invention, a slot 18 is provided between the first and second c-beams 12, 14 to receive a connector 16, 16', 16" therein. The slot 18 provides a cantilever receptacle for receiving a portion of connector 16, 16', 16" as described herein. In one embodiment of the present invention, the slot 18 may be provided by disposing a spacer 20 between the first and second c-beams 12, 14. It is contemplated that the spacer 20 may be made from steel, a polymeric material or any other material suitable to maintain sufficient spacing between the c-beams 12, 14 proximate their first and second ends so that a portion of a connector 16, 16' may be received there between.

According to the present invention, all or parts of the building system can be pre-wired, plumbed, and set up for HVAC with minimal connections to be attached to infrastructure framework as a "plug in" building. As seen in FIGS. 2 and 3 apertures are located in the web of the structural beams to allow for air flow, and/or raceways for electrical, HVAC, and plumbing. As discussed below, these apertures may also be uses to provide mounting points for floor plates 66 or roof plates 68.

The structural columns 22 of the present invention are depicted in FIGS. 8-16. According to the present invention, each column comprises a plurality of adjacently disposed, elongated and angled plates 24. In one preferred embodiment, each column is comprised of four 3/16" thick steel plates 24 press formed into angles and connected together by a series of fasteners 36 to form a cruciform shape. These structural columns 22 provide a pathway for loads to be transferred from the roof and floor modules of the structural system and from the columns 22 to the foundation 8 upon which the structural system is ultimately connected. According to the present invention, spacers 20 or "packer plates" are also disposed between the plates 24 forming the columns 22 to provide a constant gap which enables a portion of the connectors 16 to be received by, and fastened to, the columns 22. The height of the columns 22 is preferably designed on a 2'6" module, ranging from 2'6" to 15'. However, it is contemplated that the columns 22 be of any suitable length without departing from the present invention.

As discussed above, the structural beams 10 and columns 22 of the overall structural framework are secured one to the other by a plurality of connectors 16, 16'. The connectors 16, 16' not only provide means to attach the structural components (i.e., beams to beams, beams to columns and columns to foundation), but also facilitate the transfer of loads between beams 10, from beams 10 to columns 22, from above floor columns 22 to below floor columns (not shown), and from below floor columns 22 to the foundation 8. Accordingly, the connectors 16, 16' provide structural integrity to the overall structural system by providing a pathway for loads to travel from component to component. Various embodiments of connectors 16, 16' suitable for use with the present invention now will be described.

Figure 4:
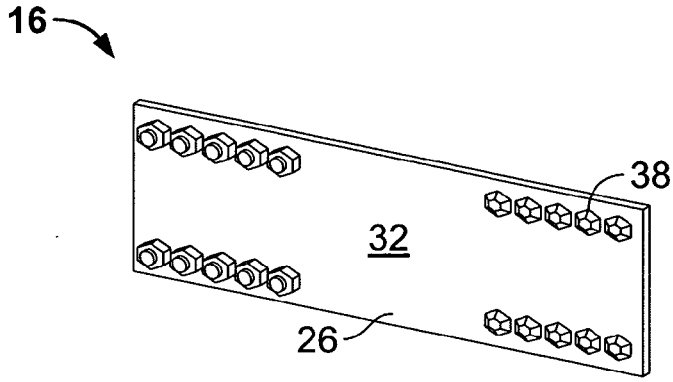
FIG. 4 is a perspective view of one embodiment of a beam to beam connector according to the present invention.

In one embodiment of the invention illustrated in FIG. 4, the structural connector 16 comprises a blade 26 having opposed first and second ends 26*a*, 26*b* and opposed faces 32. According to the present invention, a pair of c-beams 12, 14 (as described) above are connected one to the other on opposed faces 32 of the first end 26*a* of the blade 26. Another pair of the c-beams 12, 14 are securably attached to opposed faces 32 of the second end of the blade 26. Alternatively, the structural connector may be configured to connect more than two beams 10 in a structure. In this case, the structural connector 16 comprises a plurality of transverse blades 26. Each of the plurality of blades provided to connect a pair of c-beams 12, 14 one to the other on opposed faces 32 of each the blades 26.

Figure 5:
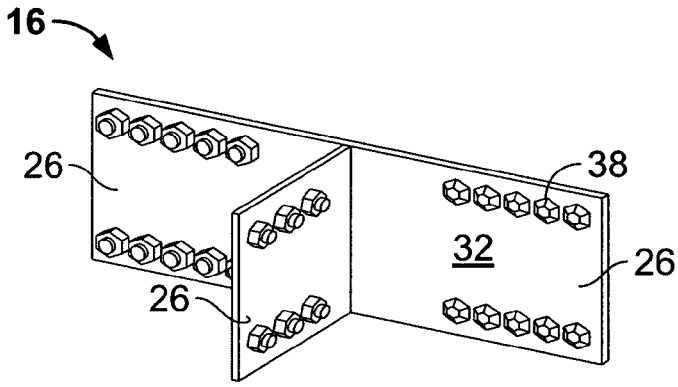
FIG. 5 is a perspective view of another embodiment of a roof or floor beam to beam connector according to the present invention.
Figure 6:
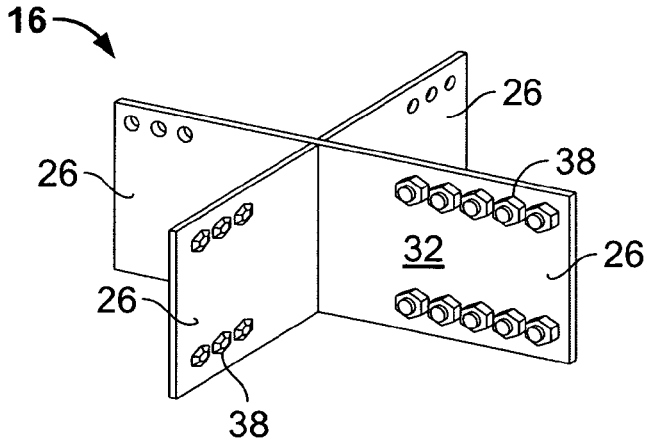
FIG. 6 is a perspective view of another embodiment of a roof or floor beam to beam connector according to the present invention.

In a preferred embodiment shown in FIGS. 4-6, the blades 26 includes apertures disposed proximate the marginal edge 38 of the blades 26. The apertures are provided to receive fasteners 36. The fastener 36 may be bolts, pins, studs or any other fastener suitable for securably connecting the c-beams 12, 14 to the connector 16. It is also contemplated that the apertures be detents in the surface of the marginal edge 38 of the blade 26. In such a configuration, it is contemplated that the c-beams 12, 14 include corresponding protrusions that cooperatively engage the detents to securably attach each c-beams 12, 14 to the connector 16. Alternatively, the c-beams 12, 14 may be securably attached to the connectors 16 by welding.

The blade 26 of the connector 16 may be configured to accommodate connection of c-beams 12, 14 in either an orthogonal or non-orthogonal architectural structural system. For example, it is contemplated that the blade 26 be formed to an angle other than 90° (e.g., 60° or 45°) to accommodate a non-orthogonal architectural structural system (e.g., a triangle), or to 90° or 180° to accommodate an orthogonal structure. Generally, the connectors 16 are made from steel having a thickness of 0.50 inches to 2.0 inches. However, it is contemplated that the connectors 16 be made from any material and of varying thickness suitable for application of a particular structural system.

In another embodiment, shown in FIGS. 8-10 (and FIG. 12), the structural connector 16' further includes a beam adaptor 42 and at least one column adaptor 44. The beam adaptor 42 comprises a plurality of transverse columnar blades 46 having opposed faces 32. Each of the columnar blades 46 of the beam adaptor 42 may be connected to a separate structural beam 10. The column adaptor 44 also comprises a plurality of columnar blades 46. The columnar blades 46 of the column adaptor 44 extend perpendicularly from the beam adaptor 42 proximate the juncture 48 of the transverse blades 26'. The column adaptor 44 for connection structural columns 22 to structural beams 10. As shown in FIG. 12, the structural connector 16' may include column adaptors 44 that perpendicularly extend from the beam adaptor 42 in either or both of an upward or downward as direction as dictated by the need to connect upwardly or downwardly extending columns 22.

As seen in FIG. 14, the columns 22 also attach to the foundational surface 8 in similar fashion as described above. The connector 16" for attaching structural columns 22 to the foundation 8 comprises a base member 50 having a top surface 52 and a plurality of transverse blades 54, extending perpendicularly from the top surface 52. The base member 50 may be bolted to the foundational surface 8 by conventional means.

As shown in FIGS. 15-17, the repeatable modular framework may further be stabilized using horizontal and vertical cross bracings 56. Specifically, the cross bracings 56 provide structural stability to resist wind loads. According to the present invention, the vertical and horizontal cross bracings 56 each comprise tension rods 58 having opposed first and second ends. The first and second ends of the tension rods 58 of both the vertical horizontal are securably connected to one of the plurality of structural connectors 16, 16', 16" at the roof line and floor line of adjacent structural columns 22 of the structure in an "X" configuration. According to one embodiment, the structural connectors 16, 16', 16" each include a flange 60 disposed between each of plurality of transverse blades 26' to accommodate connection of the cross bracings 56. The tension (or compression) of the cross bracings 56 may be adjusted by a cleavis 62 disposed at the ends of each of the tension rods 58.

The present invention may be used in connection with architectural structures being constructed at varying elevations. As shown in FIGS. 18 and 19, a structural elbow 64 may be employed to accommodate two-way transfer of loads transfers throughout the structure where there is a change in floor elevation that is not on the column line. According to the present invention the elbow 64 has opposed first and second ends that may be securably attached to a perpendicularly extending columnar blade 46 of a connector 16' having a column adaptor. The fastener may be bolts, pins, studs or any other fastener suitable for securably connecting the elbow to the connector 16'.

As shown in FIGS. 20-23 floor plates 66 and roof plates 68 are provided to accommodate applicable loads. According to one preferred embodiment of the present invention, the floor and roof plates 66, 68 are fabricated with 9 approx. 2'-3"×2'-3" press formed panels (roof 12 gauge and floor 10 gauge). However, it is contemplated that the floor and roof plates 66, 68 may be formed from any number of press formed panels of any dimension without departing from the present invention. Furthermore, the floor and roof plates 66, 68 are designed to be attached in any appropriate manner to the c-beams. As shown in FIGS. 25 and 26 a press formed roof fascia 70 is also provided. The roof fascia 70 is provided to edge and conceal roofing material as well as any utilities or HVAC components located on the roof of the architectural structure.

As shown in FIG. 24 sub-floor plates 72 are provided to accommodate applicable loads and seal the slots 18 between c-beams 12, 14 from under the floor of the architectural structure. According to one preferred embodiment of the present invention, the sub-floor plates 72 are fabricated from four press formed panels (16 gauge) and are attached to the top of the lower flange of the c-beams 12, 14. The sub-floor plates 72 may be formed from any number of press formed panels, and of any suitable gauge without departing from the present invention.

While specific embodiments have been illustrated and described, numerous modifications are possible without departing from the spirit of the invention, and the scope of protection is only limited by the scope of the accompanying claims.

What is claimed is:

1. An architectural structural system comprising:

a structural beam comprising a first c-beam and second c-beam adjacently disposed one in parallel to the other, each of the c-beams having opposed first and second ends; and, a structural connector comprising at least two transverse blades projecting radially outward from a single axis joint and having opposed faces and a lower edge, each of the transverse blades being connectedly disposed between the first and second c-beams securedly connected thereto and at least two columnar blades each integrally formed and coplanar with and extending downwardly from the lower edge of a corresponding transverse blade, one of the at least two columnar blades connectedly disposed between elongated angled column plates securedly connected thereto.

2. The architectural structural system of claim 1, further comprising a spacer, the spacer being disposed between the first and second c-beams to provide a slot between the first and second c-beams for receiving the structural connector therein.

3. The architectural structural system of claim 1, wherein each of the c-beams further includes at least one aperture disposed proximate the opposed first and second ends, and wherein at least one of the transverse blades further includes at least one aperture disposed along a marginal edge of the blades and positioned in spatial alignment with the at least one aperture in each of the first and second c-beams.

4. The architectural structural system of claim 3, further comprising at least one fastener extended through the spatially aligned apertures in the transverse blade, the first c-beam, and the second c-beam, the fastener to provide a secured connection between the first c-beam, the structural connector and the second c-beam.

5. The architectural structural system of claim 1, wherein each the plurality of transverse blades are configured to accommodate connection of a plurality of structural beams in an orthogonal architectural structural system.

6. The architectural structural system of claim 1, wherein each columnar blade is co-planar with and extends perpendicularly from a transverse blade so as to connect a column to at least one beam.

7. The architectural structural system of claim 6, further comprising a column, the column comprising four adjacently disposed elongated angled plates securedly connected to the columnar blades of the column adaptor.

8. A repeatable framework for an architectural structural system comprising:

a plurality of connectors, each connector comprising:

at least two transverse blades projecting radially outward from a single axis joint at one end thereof and having opposed faces and a lower edge, each of the transverse blades connected at a distal end thereof to an adjacently disposed pairs of c-beams in an architectural structural system one to the other on opposed faces of the respective blades; and, at least two columnar blades extending downwardly and perpendicularly from the lower edge of a corresponding transverse blade with each columnar blade being coplanar with that transverse blade and provided to connect a column to at least one beam;

a plurality of structural beams, each structural beam comprising a pair of adjacently disposed c-beams, each pair of c-beams being connected at opposed ends by one the plurality of connectors, and each structural beam being connected to another of the plurality of structural beams by another of the plurality of blades of a common structural connector; and, a plurality of columns, each column comprising a plurality of adjacently disposed elongated angled plates connected one to the other by a connector, and each column being connected at opposed ends to two of said plurality of structural beams by a common one of the plurality of connectors.

9. The repeatable framework of claim 8, wherein each of the beams is of equal length.

10. The repeatable framework of claim 9, wherein the structural beams and columns are attached to the connectors by fasteners extending through spatially aligned apertures in the blades and the structural connectors.

11. The repeatable framework of claim 8, wherein each of c-beams further includes at least one aperture disposed proximate the opposed first and second ends of the c-beams, and wherein the transverse blades of the connector further includes at least one aperture disposed along a marginal edges of the blades and positioned in spatial alignment with the at least one aperture in each of the c-beams.

12. The repeatable framework of claim 8, wherein the plurality of structural beams are orthogonally connected one to another.

13. The repeatable framework of claim 8, wherein each the plurality of transverse blades of each connector are configured to accommodate connection of a plurality of structural beams in an orthogonal architectural structural system.

14. The repeatable framework of claim 13, wherein the plurality of structural beams are connected to the columns to define a cubical structural bay.

15. The repeatable framework of claim 13, wherein the plurality of structural beams are connected one to another in a non-orthogonal configuration.

16. The repeatable framework of claim 15, wherein the plurality of structural beams are connected to the columns to define a structural bay.

17. The repeatable framework of claim 8, further comprising cross bracings, wherein the cross bracings comprise tension rods having opposed first and second ends, the first and second ends each being securably connected to one of the plurality of structural connectors.

18. The repeatable framework of claim 8, further comprising an elbow having opposed first and second ends to securably connect the beam to a second beam disposed at a second elevation when elevation change does not occur on a column line.

19. The repeatable framework of claim 8, wherein the structural beams provide raceways for at least one of HVAC, electrical, plumbing, floor plates and roof plates.

20. A structural connector for connecting both horizontal beams and vertical columns in an architectural structural system comprising:

at least two horizontal transverse blades projecting radially outward from a single axis joint with each having opposed faces and a lower edge, the opposed faces being connectedly disposed between a pair of parallel disposed c-beams securely connected thereto and forming architectural beams in the system;

at least two vertical columnar blades having opposed faces with each vertical columnar blade connectedly disposed between a pair of elongated angular column plates securedly connected thereto and forming architectural columns in the system; and, each columnar blade being coplanar with a horizontal transverse blade and extending perpendicularly and vertically from the lower edge of a corresponding horizontal transverse blade.

21. The structural connector of claim 20, wherein each the plurality of horizontal transverse blades is configured to accommodate connection of adjacently disposed pairs of c-beams in an orthogonal architectural structural system.

22. The structural connector of claim 21, wherein the plurality of horizontal transverse blades from a T-shaped configuration.

23. The structural connector of claim 20, wherein each the plurality of horizontal transverse blades is configured to accommodate connection of adjacently disposed pairs of c-beams in a non-orthogonal architectural structural system.

24. The structural connector of claim 20, wherein each of the blades further includes at least one aperture disposed proximate the marginal edge of the respective blade, the at least one aperture provided to receive a fastener therein.

25. The structural connector of claim 20, wherein each connector is made from steel.

26. The structural connector of claim 20, wherein each connector has a thickness of 0.05 inches to 5.0 inches.

a plurality of columnar blades extending perpendicularly from the structural connector proximate the juncture of the plurality of transverse blades, the column adaptor provided to connect a column to at least one beam.

27. The structural connector of claim 20, further comprising a flange disposed between each of plurality of horizontal transverse blades, the flange provided for securable connection of cross bracings in an architectural structure.

28. A structural orthogonal connector for an architectural structural system comprising:

at least two horizontal transverse blades projecting radially outward from a single axis joint with each having opposed faces and a lower edge, the shape of the structural connector selected from the group including an X-shape, or a T-shape, or an L-shape, each horizontal transverse blade connectedly disposed between a pair of parallel disposed c-beams securedly connected to the opposed faces and forming architectural beams in the system;

at least two vertical columnar blades with each having opposed faces and with each vertical columnar blade connectedly disposed between a pair of elongated angular column plates securedly connected to the opposed faces and forming architectural columns in the system; and, each columnar blade being coplanar with a horizontal transverse blade and extending perpendicularly and vertically from the lower edge of a corresponding horizontal transverse blade.

29. The structural connector of claim 28, wherein each of the horizontally transverse blades is configured to accommodate connection of a plurality of adjacently disposed pairs of c-beams in an orthogonal architectural structural system.

30. The structural connector of claim 29, wherein each of the blades further includes at least one aperture disposed proximate the marginal edge of the respective blade, the at least one aperture provided to receive a fastener therein.

31. The structural connector of claim 28, wherein each connector is made from steel.

32. The structural connector of claim 28, wherein each connector has a thickness of 0.05 inches to 5.0 inches.

33. An architectural structural system comprising:

A) a first connector interconnecting at least two horizontal beams including:

a plurality of transverse horizontal blades with each blade having opposed faces to connect at least two adjacently disposed pairs of horizontally positioned c-beams to one another on the opposed horizontal faces of the blade;

B) a second connector interconnecting at least two horizontal beams to at least one vertical column including:

each element of the first connector and a plurality of columnar vertical blades extending perpendicularly in one vertical direction from the plurality of horizontal transverse blades with each columnar blade being coplanar with a transverse blade and with each columnar blade having opposed faces connecting at least two vertically positioned, adjacently disposed elongated angled plates to one another on the opposed faces of the blade; and, C) a third connector interconnecting at least two vertical columns to at least one horizontal beam including:

each element of the second connector and a plurality of vertical columnar blades extending perpendicularly in a vertical direction opposite the one vertical direction from the plurality of horizontal transverse blades with each columnar blade being coplanar with a transverse blade and with each columnar blade having opposed faces connecting at least two vertically positioned, adjacently disposed elongated angled plates to one another on the opposed faces of the blade.

34. The architectural structural system of claim 33, wherein the angle between adjacent horizontal transverse blades is 90 degrees and a profile of the transverse blades of a connector is one of an X-shape, T-shape, or L-shape.

* * * * *

UNITED STATES PATENT AND TRADEMARK OFFICE

CERTIFICATE OF CORRECTION

PATENT NO. : 7,310,920 B2
APPLICATION NO. : 10/840440
DATED : December 25, 2007
INVENTOR(S) : David Hovey, Jr.

It is certified that error appears in the above-identified patent and that said Letters Patent is hereby corrected as shown below:

Delete Column 9, lines 46-49.

Signed and Sealed this

Fourth Day of November, 2008

JON W. DUDAS
*Director of the United States Patent and Trademark Office*